US009988745B2

(12) United States Patent
Sanchez et al.

(10) Patent No.: US 9,988,745 B2
(45) Date of Patent: Jun. 5, 2018

(54) ENHANCED CHAR INTEGRITY FABRIC

(71) Applicant: Milliken & Company, Spartanburg, SC (US)

(72) Inventors: John L. Sanchez, Moore, SC (US); Lei Zhang, Stamford, CT (US)

(73) Assignee: Milliken & Company, Spartanburg, SC (US)

( * ) Notice: Subject to any disclaimer, the term of this patent is extended or adjusted under 35 U.S.C. 154(b) by 304 days.

(21) Appl. No.: 15/053,070

(22) PCT Filed: Jun. 23, 2014

(86) PCT No.: PCT/US2014/043665
§ 371 (c)(1),
(2) Date: Feb. 25, 2016

(87) PCT Pub. No.: WO2015/041734
PCT Pub. Date: Mar. 26, 2015

(65) Prior Publication Data

US 2016/0237599 A1 Aug. 18, 2016

Related U.S. Application Data

(60) Provisional application No. 61/881,176, filed on Sep. 23, 2013.

(51) Int. Cl.
*D03D 15/12* (2006.01)
*D03D 1/00* (2006.01)
*D03D 13/00* (2006.01)

(52) U.S. Cl.
CPC ..... *D03D 15/12* (2013.01); *D03D 1/0035* (2013.01); *D03D 1/0047* (2013.01); *D03D 13/00* (2013.01);

(Continued)

(58) Field of Classification Search
CPC ..... D03D 15/12; D03D 13/00
See application file for complete search history.

(56) References Cited

U.S. PATENT DOCUMENTS 4,900,613 A 2/1990 Green ..... 428/225
4,918,795 A 4/1990 Dischler ..... 26/1
(Continued)

FOREIGN PATENT DOCUMENTS

EP 0 373 871 6/1990
GB 2 025 789 9/1982

OTHER PUBLICATIONS

Patent Cooperation Treaty PCT International Search Report. dated, Sep. 30, 2014. International Application No. PCT/US2014/043665. International Filing Date: Jun. 23, 2014.

*Primary Examiner* — Andrew Piziali
(74) *Attorney, Agent, or Firm* — Cheryl J. Brickey

(57) ABSTRACT

An enhanced char integrity fabric containing a plurality of warp yarns in the warp direction and a plurality of weft yarns in the weft direction. The warp yarns and the weft yarns contain thermoplastic fibers having a melting temperature less than about 300° C. The enhanced char integrity fabric also contains a plurality of char reinforcing yarns in at least the warp direction. The char reinforcing yarns have a different composition than the warp yarns and the weft yarns and contain non-melting fibers having a decomposition temperature greater than 300° C. The char reinforcing yarns are in an amount of less than about 30% wt of the warp yarns and the tensile strength of the char reinforcing yarns is about equal or less than the tensile strength of the warp yarns.

20 Claims, 3 Drawing Sheets

(52) U.S. Cl.
CPC ..... *D10B 2201/02* (2013.01); *D10B 2331/02* (2013.01); *D10B 2331/021* (2013.01); *D10B 2331/04* (2013.01); *D10B 2401/041* (2013.01); *D10B 2501/00* (2013.01)

(56) References Cited

U.S. PATENT DOCUMENTS

| | | | | |
|---|---|---|---|---|
| 5,033,143 | A | 7/1991 | Love, III | 8/158 |
| 5,433,991 | A | 7/1995 | Boyd, Jr. et al. | 428/193 |
| 5,447,787 | A | 9/1995 | Shaffer | 428/229 |
| 5,482,763 | A | 1/1996 | Shaffer | 428/229 |
| 6,003,565 | A | 12/1999 | Whittier, II et al. | 139/420 A |
| 6,546,605 | B1 | 4/2003 | Emery et al. | 28/167 |
| 6,624,096 | B2 | 9/2003 | Thomas et al. | 442/181 |
| 6,840,288 | B2 | 1/2005 | Zhu et al. | 139/425 R |
| 7,393,800 | B2 | 7/2008 | Corner | 442/302 |
| 7,589,036 | B2 | 9/2009 | Corner et al. | 442/301 |
| 7,713,891 | B1 | 5/2010 | Li et al. | 442/136 |
| 7,741,233 | B2 * | 6/2010 | Sasser | D03D 15/12 442/136 |
| 7,932,194 | B2 * | 4/2011 | Bader | A41D 31/0027 139/408 |
| 8,012,890 | B1 | 9/2011 | Li et al. | 442/136 |
| 8,333,221 | B2 * | 12/2012 | Ly | B32B 5/26 139/383 R |
| 2003/0203690 | A1 | 10/2003 | Hess et al. | 442/181 |
| 2005/0186875 | A1 | 9/2005 | Lilani | 442/189 |
| 2008/0086798 | A1 | 4/2008 | Allen, II et al. | 2/458 |
| 2011/0275264 | A1 | 11/2011 | McBride et al. | 442/143 |

* cited by examiner

ENHANCED CHAR INTEGRITY FABRIC

RELATED APPLICATIONS

This application claims priority to PCT application PCT/US14/43665 filed on Jun. 23, 2014 which claims priority to provisional U.S. application 61/881,176 filed on Sep. 23, 2013, both of which are herein incorporated by reference in their entirety.

FIELD OF THE INVENTION

The present invention generally relates to flame resistant fabrics and fabrics having char strength after burning.

BACKGROUND

For the military, firefighters, foundry workers and other workers whose occupations expose them to extreme heat and fire, safety is a paramount concern. Working in and around environments wherein one is exposed to extreme heat and fire continually subjects workers to risks of being seriously burned. Accordingly, it is a necessity that the clothing of such military workers and other personnel provide a high degree of heat and fire resistance protection to protect such workers against the hazards of their work environments and in addition it is desirable to have a fabric that has enhanced char integrity.

BRIEF SUMMARY

An enhanced char integrity fabric containing a plurality of warp yarns in the warp direction and a plurality of weft yarns in the weft direction. The warp yarns and the weft yarns contain thermoplastic fibers having a melting temperature less than about 300° C. The enhanced char integrity fabric also contains a plurality of char reinforcing yarns in at least the warp direction. The char reinforcing yarns have a different composition than the warp yarns and the weft yarns and contain non-melting fibers having a decomposition temperature greater than 300° C. The char reinforcing yarns are in an amount of less than about 30% wt of the warp yarns and the tensile strength of the char reinforcing yarns is about equal or less than the tensile strength of the warp yarns.

Other embodiments of this invention feature char reinforcement yarns in the weft direction or warp and weft directions.

DETAILED DESCRIPTION

"Flame resistant", in this application means a material that provides a thermal barrier and reduces body burn as described in NFPA 1971 and allows the user time to escape the flames and/or fire. Such a fabric would preferably resist ignition and be self-extinguishing.

Figure 1:
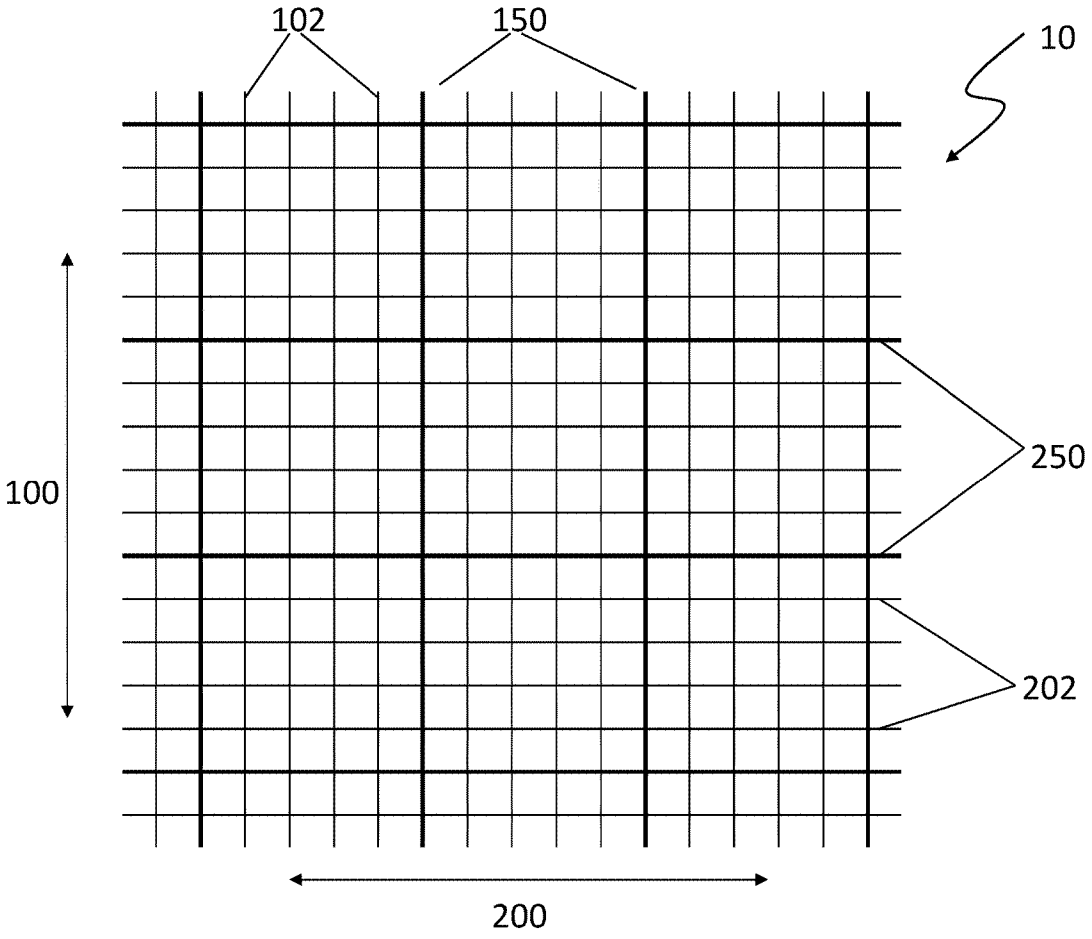
FIGS. 1-3 are schematic illustrations of different embodiments of the enhanced char integrity fabric.

There is a need for fabric to have strength and integrity after burning. The conventional solution to provide char integrity is to make the entire garment from char reinforcing yarns or using blended yarns with a high percentage of char reinforcing fibers. Char reinforcing yarns are often expensive, difficult to dye, and uncomfortable to wear. By using selective yarn reinforcement of lower cost flame resistant fabrics, it is possible to have better appearance, comfort, and cost. These char reinforcing yarns may be in the warp and/or weft of the fabric and are placed at intervals through the fabric. These char reinforcing yarns are designed primarily to have strength after burning and therefore the char reinforcing yarns may actually have the same or less unburned tensile strength than the yarns they are reinforcing. FIG. 1 shows one embodiment of an enhanced char integrity fabric 10 being a woven fabric containing a warp direction 100 and a weft direction 200. The warp direction 100 contains warp yarns 102 and char reinforcing yarns 150. The weft direction 200 contains weft yarns 202 and char reinforcing yarns 250. While FIG. 1 shows char reinforcing yarns (150, 250) in both the warp direction 100 and the weft direction 200, the char reinforcing yarns (150, 250) may also be in only one or the other direction (100, 200). Both the warp 150 and weft 250 char reinforcing yarns and the warp 102 and weft 202 yarns may have different compositions and sizes.

The char reinforcing yarns may be introduced into the fabric in similar manner to a strengthening yarn in a ripstop fabric. The char reinforcing yarns are in an amount of less than about 30% by weight of the fabric, more preferably less than about 20%, more preferably less than about 15% by weight of the fabric. In another embodiment, the char reinforcing yarns are in an amount of less than about 14% by weight of the fabric, more preferably less than about 10%, more preferably less than about 5% by weight of the fabric. Unlike traditional reinforcement yarns in a ripstop fabric, the char reinforcing yarns provide little to no strengthening of the finished product. It is not until the fabric is burned that the char reinforcement yarns have a higher tensile strength than the other warp and weft yarns.

Preferably, the char reinforcing yarns are placed in the warp and/or weft direction in a repeating pattern. In one embodiment, the char reinforcement yarns are inserted into the fabric every 2 to 50 warp or weft yarns, more preferably every 3 to 20 warp or weft yarns. In one embodiment, the char reinforcement yarns are in the warp and/or the weft direction and are spaced apart between about 0.5 and 2.5 cm. The ratio of char reinforcing yarns to warp or weft yarns can be adjusted to accommodate the desired level of reinforcement.

The enhanced char integrity fabric may be of any suitable construction including woven, non-woven, and knit. In one embodiment, the weft yarns extend in a weft direction transverse to the warp direction and are interwoven with the warp yarns. Preferably, the fabric is a woven fabric and may be constructed of any weave such as plain, satin, or twill, ripstop, herringbone, or paradox weaves.

In another embodiment, the fabric is a knit, for example a circular knit, reverse plaited circular knit, double knit, single jersey knit, two-end fleece knit, three-end fleece knit, terry knit or double loop knit, weft inserted warp knit, warp knit, and warp knit with or without a micro-denier face. In another embodiment, the fabric is a multi-axial, such as a tri-axial fabric (knit, woven, or non-woven). In another embodiment, the fabric is a bias fabric. In another embodiment, the fabric is a unidirectional fabric and may have overlapping yarns or may have gaps between the yarns.

The warp yarns 102 and weft yarns 202 contain thermoplastic fibers having a melting temperature of less than about 300° C. Thermoplastic fibers are typically considered non-fire resistant as they do not form char and can melt and drip. However, they provide desirable characteristics like strength and abrasion resistance. The combination of thermoplastic and non-thermoplastic components provides a good balance of strength and FR (fire resistant). Preferably, the warp and/or weft yarns contain yarns having a blend of FR treated nylon/cotton. In one embodiment, the nylon/cotton is in a 52%/48% by weight ratio treated with a fire resistant chemistry. In one preferred embodiment, the warp and weft yarns comprise cellulosic fibers such as cotton and rayon and a thermoplastic selected from the group consisting of polyamides, polyesters, polyethylene, polypropylene, and copolymers thereof. In addition to the thermoplastic fibers, the warp and weft yarns may also contain any additional suitable fibers. In one embodiment, the weft and/or warp yarns contain non-melting fibers having a decomposition temperature ($t_d$) of greater than about 300° C.

In one embodiment, the warp yarns contain FR fibers that resist burning, but may or may not be char reinforcing. In another embodiment, the weft yarns contain FR fibers. In another embodiment, both the warp yarns and the weft yarns contain FR fibers. The FR fibers used in the warp direction may be the same or different to the FR fibers used in the weft direction. Further, more than one type of FR fibers may be used in the warp and/or weft direction, randomly or in a set pattern.

Having some FR fiber content may make the warp yarns and/or weft yarns FR yarns. The yarns may be flame resistant due to the inherent FR nature of the fibers or may be due to FR chemicals applied as an additive or coating in or on the fibers and/or yarn. The FR treatment of the yarns to make the yarns FR may be conducted on the fibers before the fibers are formed into yarns, on the yarns before being formed into a fabric, or on the fabric (and therefore yarns) after fabric formation. If the yarn is not inherently FR, then the yarn is not considered FR until it is treated with the FR chemistries. In one embodiment, the char reinforcing fabric is treated with FR chemistry after the fabric is formed.

The char reinforcement yarn is selected to retain a large portion of its tensile strength after the fabric is burned. This results in a fabric that has greater char integrity over non-reinforced fabrics. Improvement in fabric char integrity can be seen in decreased char length in the ASTMD 6413 vertical burn test of char reinforced fabrics compared to conventional fabrics. Preferred char reinforcement yarns yield a fabric with at least 1 inch shorter char length than unreinforced fabrics.

It is difficult to remove individual yarns of a burned fabric for tensile testing. In order to estimate the tensile strength of burned yarns, skeins of yarns were heated in a convection oven at 300° C. for 10 minutes in order to simulate the damage the yarn would receive on burning. Yarn tensile strength can then be measured in both the unheated and post-heated states according to ASTM D2256. Preferred char reinforcement yarns have a post-heated yarn tensile strength of at least 50% of their unheated yarn tensile strength.

Any suitable flame resistant fibrous materials could be used as a component in the weft or warp yarns including, but not limited to: aramids, meta-aramids, FR rayon, FR polynosic rayon, flame resistant cellulosics such as flame resistant cotton or acetate, flame resistant polyester, FR polyvinyl alcohol, polytetrafluoroethylene, flame resistant wool, polyvinyl chloride, polyetheretherketone, polyetherimide, polyethersulfone, polychlal, polyimide, polyamide, polyaramide, polyimideamide, polyolefin, polybenzoxazole, carbon, modacrylic acrylic, melamine, glass, or any other flame resistant materials that can be used for the manufacture of fabrics for garments or other fabric applications. "FR cotton" means that the cotton yarns are treated with an FR additive or coating before or after fabric formation.

The char reinforcing yarns are any suitable yarn having the same or lower tensile strength than the weft and warp yarns, but higher char tensile strength. The char reinforcing yarns have a different composition than the warp and weft yarns. "Different composition" in this application is defined to mean that the char reinforcing yarns contain different materials or different amounts of materials as compared to their respective warp or weft yarns. In one embodiment, both the warp/weft yarns and the char reinforcing yarns contain cotton and NOMEX™, except that the char reinforcing yarns contain a higher percentage by weight of the NOMEX™. In this embodiment, the warp/weft yarns and the char reinforcing yarns have different compositions according to the definition set forth in this specification.

In one embodiment, the char reinforcing yarns contain non-melting fibers having a decomposition temperature ($T_d$) of greater than about 300° C. In one embodiment, the non-melting fibers are a thermoset or natural material. In another embodiment, the non-melting fibers comprise a material selected from the group consisting of aramids such as NOMEX™ or KEVLAR™, glass, polynosic rayon, flame resistant cellulosic material, flame resistant wool, polyetheretherketone, polyetherimide, polyimide, modacrylic, carbon, melamine, Polybenzimidazole (PBI), polyphenylene oxadiazole, and aromatic polysulfonamide. In the embodiment where both the char reinforcing yarns and their respective warp and/or weft yarns contain non-melting fibers, the char reinforcing yarns contain a higher percentage by weight of non-melting fibers in the yarn.

In one embodiment, the non-melting fibers that make up the char reinforcement yarns will have significantly different properties from the remaining fibers that make up the warp and fill yarns of the fabric such as lower dyeability, a different appearance, or higher strength. Having char reinforcement yarns comprised solely of the non-melting fiber may result in a fabric that has a non-uniform or grid appearance. In some cases it may be desirable then to make char reinforcing yarns with blends of non-melting fibers and the dyeable fibers used in the warp and weft yarns so that the resulting fabric has a more uniform appearance and the char reinforcing yarns have the same or lower starting tensile strength while still having a greater char tensile strength.

In another embodiment, the char reinforcing yarns are made of spun staple fibers. Spun yarns have desirable properties such as being comfortable to wear and allowing greater freedom to make blends although they typically have lower tensile strength than multifilament fibers.

Figure 2:
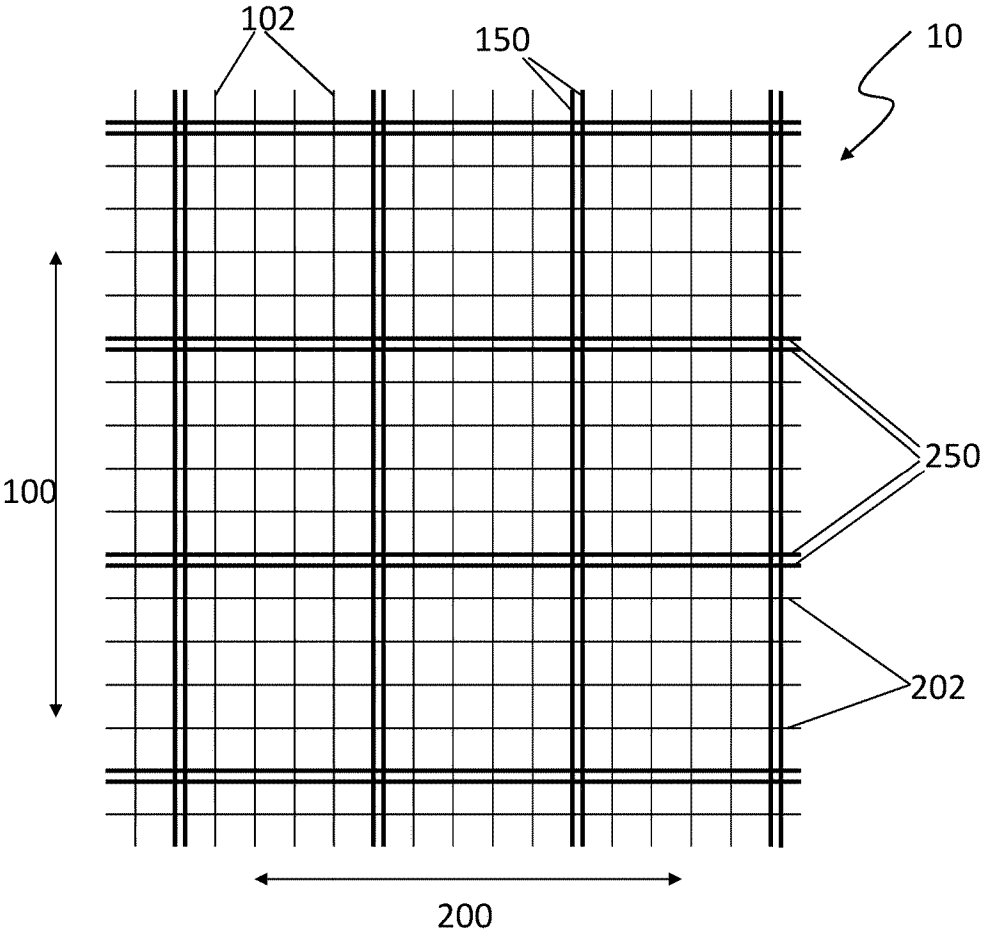

In one embodiment, the char reinforcement yarns occur in patterns where there may be two char reinforcement yarns side-by-side. This is shown for example in FIG. 2. Having two (or more) char reinforcing yarns inserted into the fabric at the same position provides additional char reinforcement to the fabric. These multiple yarns may be woven together as if they were one, as in the case of the reinforcing yarns of ripstop weave fabric, or they may be woven into the fabric separately.

In another embodiment, the char reinforcing fabric also contains ripstop yarns. The ripstop yarns have a different composition than the char reinforcing yarns, the warp yarns, and the weft yarns.

Figure 3:
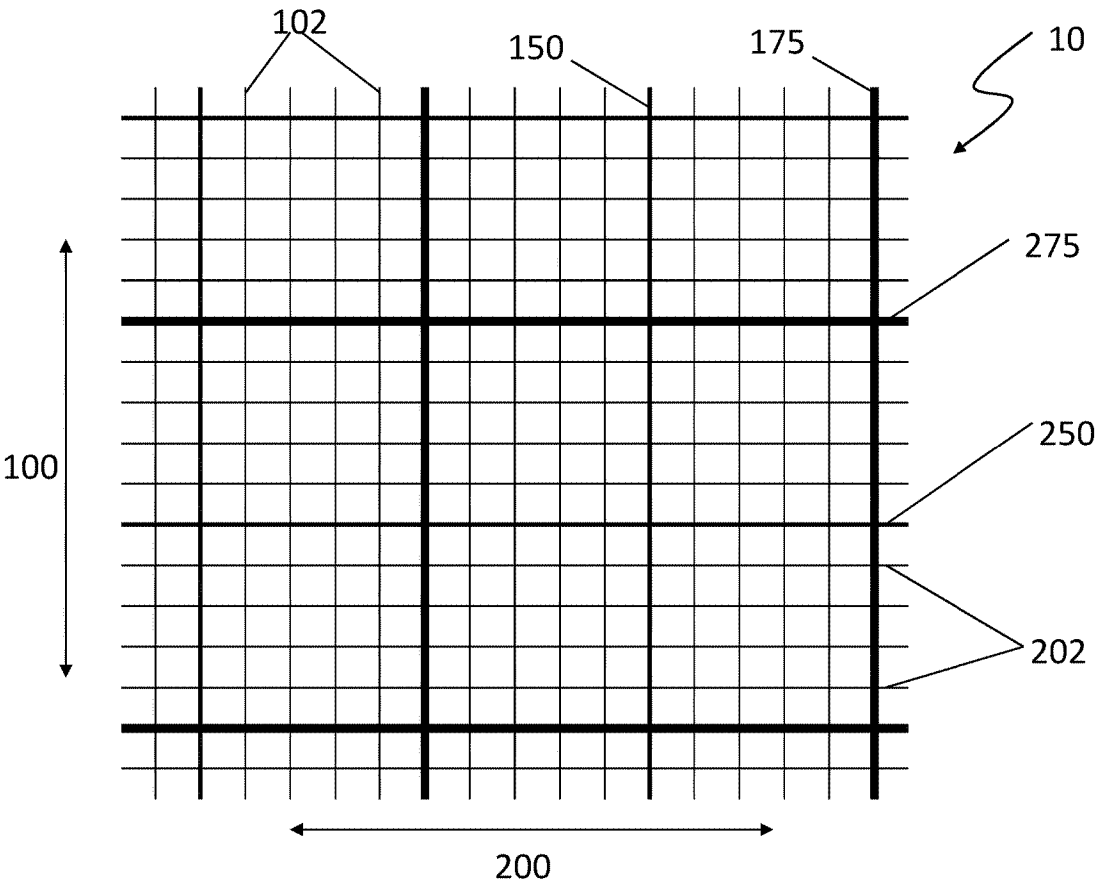

Referring now to FIG. 3, there is shown one embodiment of the enhanced char integrity fabric 10 where the fabric further contains ripstop yarns (175, 275). The ripstop yarns (175, 275) may be used in the warp and/or weft directions of the enhanced char integrity fabric to give additional tensile and tear strength to the fabric. The ripstop yarns (175, 275) may be any suitable yarn having at least 20% greater tensile strength than the warp yarns and/or weft yarns. The ripstop yarns (175, 275) would not be considered flame retardant or non-melting.

In one embodiment, the ripstop yarns (175, 275) comprise synthetic materials. The ripstop yarns may comprise continuous filament or multifilament yarns as these yarns have been shown to have high tensile strength. In another embodiment, the ripstop yarns (175, 275) comprise staple yarns.

In one preferred embodiment, the ripstop yarns comprise nylon continuous fibers.

The ripstop yarns are in an amount of preferably less than about 30% by weight of the fabric, more preferably less than about 20%, more preferably less than about 15% by weight of the fabric. In another embodiment, the ripstop yarns are in an amount of less than about 14% by weight of the fabric, more preferably less than about 10%, more preferably less than about 5% by weight of the fabric.

Preferably, the ripstop yarns (175, 275) are placed in the warp and/or weft direction in a repeating pattern. In one embodiment, the ripstop yarns are used inserted into the fabric every 2 to 50 warp or weft yarns, more preferably every 3 to 20 warp or weft yarns. In one embodiment, the ripstop yarns are in the warp and/or the weft direction and are spaced apart between about 0.5 and 2.5 cm. It has been shown that this range provides significant tensile strength and tear resistance to the enhanced char integrity fabric. Suitable polymers for ripstop reinforcements include polyamides, polyesters, and other fibers with relatively high tenacity. These yarns can be spun or multifilament. These ripstop yarns can be included as single yarns or as pairs in the warp and weft direction and pairs can be woven in the fabric as one yarn or individually.

After the warp yarns and weft yarns have been interwoven to form fabric, the fabric may optionally be subjected to a finishing application. During finishing, the fabric may be scoured by applying a detergent and water bath to the fabric. If the fabric contains cotton, the fabric may optionally be mercerized as part of the preparation for dyeing or printing. After printing, a finish may optionally be applied to the fabric. In the preferred embodiment, the finish is a moisture repellant or an FR treatment. In one embodiment, the fabric is scoured, then printed or dyed, then subjected to an FR treatment and/or other finish treatments. It is possible, however, to use other types of finishes including hydrophobic, hydrophilic, or other types of finishes.

As noted above, the invention also provides fabrics that have been treated with one or more flame retardant treatments or finishes to render the fabrics more flame resistant. Typically, such flame retardant treatments or finishes are applied to a fabric containing cellulosic fibers in order to impart flame resistant properties to the cellulosic portion of the fabric. In such embodiments, the flame retardant treatment or finish can be any suitable treatment. Suitable treatments include, but are not limited to, halogenated flame retardants (e.g., brominated or chlorinated flame retardants), phosphorous-based flame retardants, antimony-based flame retardants, nitrogen-containing flame retardants, and combinations, mixtures, or blends thereof. A preferred embodiment uses a tetrahydroxymethyl phosphonium salt (THPS)—urea precondensate that is further crosslinked with urea as in U.S. Pat. No. 8,012,890 (issued Sep. 6, 2011), incorporated herein by reference.

If desired, the fabric can be treated with one or more softening agents (also known as "softeners") to improve the hand of the treated fabric. The softening agent selected for this purpose should not have a deleterious effect on the flammability of the resultant fabric. Suitable softeners include polyolefins, ethoxylated alcohols, ethoxylated ester oils, alkyl glycerides, alkylamines, quaternary alkylamines, halogenated waxes, halogenated esters, silicone compounds, and mixtures thereof.

To further enhance the fabric's hand, the fabric can optionally be treated using one or more mechanical surface treatments. A mechanical surface treatment typically relaxes stress imparted to the fabric during curing and fabric handling, breaks up yarn bundles stiffened during curing, and increases the tear strength of the treated fabric. Examples of suitable mechanical surface treatments include treatment with high-pressure streams of air or water (such as those described in U.S. Pat. No. 4,918,795, U.S. Pat. No. 5,033,143, and U.S. Pat. No. 6,546,605), treatment with steam jets, needling, particle bombardment, ice-blasting, tumbling, stone-washing, constricting through a jet orifice, and treatment with mechanical vibration, sharp bending, shear, or compression. A sanforizing process may be used instead of, or in addition to, one or more of the above processes to improve the fabric's hand and to control the fabric's shrinkage. Additional mechanical treatments that may be used to impart softness to the treated fabric, and which may also be followed by a sanforizing process, include napping, napping with diamond-coated napping wire, gritless sanding, patterned sanding against an embossed surface, shot-peening, sand-blasting, brushing, impregnated brush rolls, ultrasonic agitation, sueding, engraved or patterned roll abrasion, and impacting against or with another material, such as the same or a different fabric, abrasive substrates, steel wool, diamond grit rolls, tungsten carbide rolls, etched or scarred rolls, or sandpaper rolls.

Additionally, if desired, the fabric can be dyed to give the fabric a desired hue, tint, or pattern. The dyeing of the fabric generally is done following the scouring of the fabric and prior to the application of the finish. Furthermore, the fabric can be printed using conventional printing techniques for the majority components of the yarns.

EXAMPLES

Example 1

A char reinforced fabric was made by first preparing a warp consisting of 15/1 ring spun 52:48 nylon:cotton yarns (802 gf/yarn tensile) and 15/1 ring spun 50:50 solution dyed tan NOMEX™:cotton (594 gf/yarn tensile). Yarn tensiles were measured according to ASTM D2256. The warp was made with a repeating pattern of twelve nylon:cotton yarns and 2 NOMEX™:cotton yarns. The fabric was woven as a ripstop fabric where the warp-directed ripstops consisted of two NOMEX™:cotton yarns woven as one. The weft yarns were the same types as used in the warp and the repeated weft weaving pattern consisted of two NOMEX™:cotton yarns woven as one to make a weft directed ripstop followed by nine nylon:cotton wefts. After weaving the fabric was scoured, mercerized, and printed in a camouflage pattern. The printed fabric was treated with FR chemistry according to the method of U.S. Pat. No. 7,713,891 B1.

Example 2

A control fabric was with the same warp as the char reinforced fabric as Example 1 but with nylon:cotton fill yarns replacing the NOMEX™:cotton fill yarns. The fabric was woven as a ripstop and prepared, printed, and FR treated as in Example 1.

Example 3

When the fabric of Examples 1 was tested in the warp direction according to ASTM D6413D, the fabric had zero afterflame and a char length of 4.5 inches. When the fabric of Example 2 was similarly tested in the warp direction, it also had zero afterflame but its char length was 6.4 inches. Upon examination of the burned fabric of example 1, it is clear that the propagation of the tear in the charred area always stops at a char reinforcing yarn. This demonstrates that the char reinforcement yarn is indeed retaining its strength after burning and improving the char integrity of the fabric.

Example 4

Weft yarns were extracted from the fabric of Example 1 both before and after flame retardant treatment. Skeins of the NOMEX™:cotton and the nylon:cotton yarns were heated in a convection oven at 300° C. for 10 minutes in order to simulate the damage the yarn would receive on burning. Tensile strength of the yarns were measured in both the unheated and post-heated states according to ASTM D2256 and are given in Table 1. It is evident that the FR treated NOMEX™:cotton yarn retains the majority of its tensile strength (86%) upon heating although it was weaker than the nylon:cotton yarn before heating. This is also the case in the yarns before FR treatment.

TABLE 1

Example test results

| Reinforcement Yarn | Greige yarn tensile [$lb_f$] | Greige Heated yarn tensile [$lb_f$] | FR Treated Unheated yarn tensile [$lb_f$] | FR Treated Heated yarn tensile [$lb_f$] | Untreated fill tear [$lb_f$] | Treated fill tear [$lb_f$] | Fill Char length [in] |
|---|---|---|---|---|---|---|---|
| 15/1 52:48 Nylon:Cotton | 1.77 | 0.29 | 1.57 | 0.05 | 14.3 | 9.1 | 6.4 |
| 15/1 50:50 NOMEX ™:Cotton | 1.31 | 0.89 | 1.07 | 0.93 | 7.9 | 6.5 | 4.5 |

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An enhanced char integrity fabric having a warp direction and a weft direction, wherein the fabric comprises:

a plurality of warp yarns in the warp direction, wherein the warp yarns comprise thermoplastic fibers having a melting temperature less than about 300° C.;

a plurality of weft yarns in the weft direction, wherein the weft yarns comprise thermoplastic fibers having a melting temperature less than about 300° C.; and, a plurality of char reinforcing yarns in the warp direction, wherein the char reinforcing yarns have a different composition than the warp yarns and a different composition than the weft yarns, wherein the char reinforcing yarns comprise non-melting fibers having a decomposition temperature greater than 300° C., wherein the char reinforcing yarns are in an amount of less than about 30% wt of the warp yarns, and wherein the tensile strength of the char reinforcing yarns is about equal or less than the tensile strength of the warp yarns.

2. The enhanced char integrity fabric of claim 1, wherein the plurality of char reinforcing yarns in the warp direction is in a repeating pattern with the warp yarns.

3. The enhanced char integrity fabric of claim 1, wherein the char reinforcing yarns in the warp direction are spaced apart between about 0.5 and 2.5 cm.

4. The enhanced char integrity fabric of claim 1, further comprising a plurality of char reinforcing yarns in the weft direction, wherein the tensile strength of the char reinforcing yarns is about equal or less than the tensile strength of the weft yarns.

5. The enhanced char integrity fabric of claim 4, wherein the plurality of char reinforcing yarns in the weft direction is in a repeating pattern with the weft yarns.

6. The enhanced char integrity fabric of claim 1, wherein the warp yarns and the weft yarns comprise cotton and a thermoplastic selected from the group consisting of nylon, polyester, polyethylene, polypropylene, and co-polymers thereof.

7. The enhanced char integrity fabric of claim 1, wherein the char reinforcement yarns are in an amount of less than about 20% wt of the fabric.

8. The enhanced char integrity fabric of claim 1, wherein the enhanced char integrity fabric further comprises a plurality of ripstop yarns in at least the warp direction, the ripstop yarns having a tensile strength of at least 20% greater than the warp yarns and the weft yarns.

9. A patterned flame resistant fabric comprising:

the enhanced char integrity fabric of claim 1; and, at least one color that is printed on the fabric to form a pattern.

10. A garment with flame resistant properties comprising the enhanced char integrity fabric of claim 1.

11. An enhanced char integrity fabric having a warp direction and a weft direction, wherein the fabric comprises:

a plurality of warp yarns in the warp direction, wherein the warp yarns comprise thermoplastic fibers having a melting temperature less than about 300° C.;

a plurality of weft yarns in the weft direction, wherein the weft yarns comprise thermoplastic fibers having a melting temperature less than about 300° C.; and, a plurality of char reinforcing yarns in the weft direction, wherein the char reinforcing yarns have a different composition than the warp yarns and a different composition than the weft yarns, wherein the char reinforcing yarns comprise non-melting fibers having a decomposition temperature greater than 300° C., wherein the char reinforcing yarns are in an amount of less than about 30% wt of the warp yarns, and wherein the tensile strength of the char reinforcing yarns is about equal or less than the tensile strength of the warp yarns.

12. The enhanced char integrity fabric of claim 11, wherein the plurality of char reinforcing yarns in the weft direction is in a repeating pattern with the weft yarns.

13. The enhanced char integrity fabric of claim 11, further comprising a plurality of char reinforcing yarns in the warp direction, wherein the tensile strength of the char reinforcing yarns is about equal or less than the tensile strength of the warp yarns.

14. The enhanced char integrity fabric of claim 11, wherein the warp yarns and the weft yarns comprise cotton and a thermoplastic selected from the group consisting of nylon, polyester, polyethylene, polypropylene, and co-polymers thereof.

15. The enhanced char integrity fabric of claim 11, wherein the char reinforcement yarns are in an amount of less than about 20% wt of the fabric.

16. The enhanced char integrity fabric of claim 11, wherein the enhanced char integrity fabric further comprises a plurality of ripstop yarns in at least the warp direction, the ripstop yarns having a tensile strength of at least 20% greater than the warp yarns and the weft yarns.

17. An enhanced char integrity fabric having a warp direction and a weft direction, wherein the fabric comprises:

a plurality of warp yarns in the warp direction, wherein the warp yarns comprise thermoplastic fibers having a melting temperature less than about 300° C.;

a plurality of weft yarns in the weft direction, wherein the weft yarns comprise thermoplastic fibers having a melting temperature less than about 300° C., a plurality of char reinforcing yarns in the warp direction and the weft direction, wherein the char reinforcing yarns have a different composition than the warp yarns and a different composition than the weft yarns, wherein the char reinforcing yarns comprise non-melting fibers having a decomposition temperature greater than 300° C., wherein the char reinforcing yarns are in an amount of less than about 30% wt of the warp yarns, and wherein the tensile strength of the char reinforcing yarns is about equal or less than the tensile strength of the warp yarns; and, a plurality of ripstop yarns in the warp direction and the weft direction, wherein the ripstop yarns have a different composition than the warp yarns, the weft yarns, and the char reinforcement yarns, and wherein the tensile strength of the ripstop yarns is at least 20% greater than the tensile strength of the warp yarns and the weft yarns.

18. The enhanced char integrity fabric of claim 17, wherein the char reinforcing yarns comprise spun yarns.

19. The enhanced char integrity fabric of claim 17, wherein the warp yarns and the weft yarns comprise cotton and a thermoplastic selected from the group consisting of nylon, polyester, polyethylene, polypropylene, and co-polymers thereof.

20. The enhanced char integrity fabric of claim 17, wherein the non-melting fibers are a thermoset or natural material.

* * * * *